US006940382B2

(12) United States Patent
Ishikawa et al.

(10) Patent No.: US 6,940,382 B2
(45) Date of Patent: Sep. 6, 2005

(54) RESIN COMPOSITION AND IGNITION COIL DEVICE USING THE SAME

(75) Inventors: Tomonori Ishikawa, Hekinan (JP); Kazutoyo Osuka, Gamagori (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 10/626,715

(22) Filed: Jul. 25, 2003

(65) Prior Publication Data

US 2005/0076857 A1 Apr. 14, 2005

(30) Foreign Application Priority Data

Jul. 26, 2002 (JP) ..... 2002-218314
May 16, 2003 (JP) ..... 2003-139601

(51) Int. Cl.[7] ..... H01F 27/02
(52) U.S. Cl. ..... 336/90; 524/413; 524/437; 524/493; 524/494
(58) Field of Search ..... 336/90; 524/413, 524/437, 493, 494

(56) References Cited

U.S. PATENT DOCUMENTS 5,324,767 A 6/1994 Koyama et al.
5,610,219 A * 3/1997 Takatani et al. ..... 524/413
5,720,264 A 2/1998 Oosuka et al.
6,337,617 B1 1/2002 Kato et al.

FOREIGN PATENT DOCUMENTS

| | | | |
|---|---|---|---|
| EP | 1209705 | A1 | 6/1999 |
| EP | 1209705 | A1 * | 5/2002 |
| JP | 8-339928 | | 12/1996 |
| JP | 9-69455 | | 3/1997 |
| JP | 11-111547 | | 4/1999 |
| JP | 2000-169678 | | 6/2000 |

OTHER PUBLICATIONS

Patent Abstracts of Japan, vol. 018, No. 377 (C–1225), Jul. 15, 1994 & JP 06 100739 A (Nippon Steel Chem Co Ltd), Apr. 12, 1994.

* cited by examiner

*Primary Examiner*—Lincoln Donovan
*Assistant Examiner*—Jennifer A. Poker
(74) *Attorney, Agent, or Firm*—Nixon & Vanderhye PC

(57) ABSTRACT

A resin composition includes a thermosetting resin and a filler dispersed in the thermosetting resin. A filler particle size curve represents a small-diameter peak, a large-diameter peak having a higher frequency than that of the small-diameter peak, and a valley which is positioned between the small-diameter peak and the large-diameter peak and has a lower frequency than that of the small-diameter peak. An ignition coil device allows the resin composition to penetrate into gaps between turns of a coil wire.

42 Claims, 5 Drawing Sheets

RESIN COMPOSITION AND IGNITION COIL DEVICE USING THE SAME

CROSS REFERENCE TO RELATED APPLICATIONS

This application is based on and incorporates herein by reference Japanese Patent Applications No. 2002-218314 filed on Jul. 26, 2002 and No. 2003-139601 filed on May 16, 2003.

FIELD OF THE INVENTION

The present invention relates to a resin composition and an ignition coil device using the same and more particularly to a resin composition mixed with a filler and an ignition coil device using the same.

BACKGROUND OF THE INVENTION

For example, a so-called stick-type ignition coil device directly mounted on a plug hole comprises members such as a housing, a central core, a primary coil, and a secondary coil. Of these members, the housing is cylindrical. The central core is formed like a round bar and is disposed approximately at the center of the housing. A cylindrical secondary spool is disposed at an outside periphery of the central core. The secondary coil is attached around the secondary spool. The secondary coil is formed by winding a secondary coil wire. A primary spool is disposed at an outside periphery of the secondary coil. The primary coil is attached around the primary spool. The primary coil is formed by winding a primary coil wire. A resin composition is injected into the housing so as to ensure insulation between the above-mentioned members stored in the housing and to fix the members. The resin composition is cured between the members.

The ignition coil device generates a thermal stress due to a cyclic load of heating and cooling as an engine operates and stops. That is to say, different linear expansion coefficients are attributed to the members constituting the ignition coil device and the resin composition. More specifically, linear expansion coefficients of the members such as the central core and the coil wire are larger than a linear expansion coefficient of the resin composition. This difference between the linear expansion coefficients causes a thermal stress. The thermal stress, if generated, may cause defects such as removal or crack on each member and the resin composition. Consequently, a dielectric breakdown may occur in the ignition coil device to disable an ignition plug from being supplied with a required high voltage.

For example, JP-A-H11-111547, introduces the ignition coil device injected with a resin composition having the adjusted linear expansion coefficient. According to the ignition coil device described in the document, the linear expansion coefficient of the resin composition is adjusted to a value approximating to the linear expansion coefficients of the central core, the primary coil wire, and the secondary coil wire. Because of this, a thermal stress hardly occurs due to a difference between linear expansion coefficients.

In order to decrease the linear expansion coefficient of the resin composition, it is a good practice to disperse a filler in the resin composition. However, dispersing the filler in the resin composition degrades the fluidity of the resin composition that is injected into the housing.

FIG. 6 shows an axial sectional view near the secondary coil of the ignition coil device. As mentioned above, a secondary coil 100 is attached around a secondary spool 101. The secondary coil 100 is formed by winding a secondary coil wire 102. A fine gap 108 is formed between turns of the secondary coil wire 102. The secondary coil wire 102 comprises a conductor 103 and a coat 104.

A resin composition 105 comprises a thermosetting resin 106 and a filler 107. If the filler 107 is not included, the resin composition 105 smoothly penetrates between turns of the secondary coil wire 102 through the gap 108. The resin composition 105 is cured between turns of the secondary coil wire 102 and ensures insulation for the secondary coil wire 102. The resin composition 105 hinders the secondary coil wire 102 from being wound irregularly.

If the filler 107 is dispersed in the resin composition 105, however, the filler 107 hinders the resin composition 105 from passing through the gap 108. This makes it difficult for the resin composition 105 to penetrate between turns of the secondary coil wire 102. FIG. 6 illustrates this state. Accordingly, it is difficult to ensure insulation for the secondary coil wire 102. In addition, the secondary coil wire 102 easily becomes wound irregularly.

In consideration for this, JP-A-H4-345640, introduces the coil-that ensures fluidity of the resin composition injected into the housing by widening the filler's size distribution and applying the closest packing. However, this document provides no description about a specific form of the particle size curve.

SUMMARY OF THE INVENTION

It is an object of the present invention to provide a resin composition excellent in the fluidity. It is another object of the present invention to provide an ignition coil device in which a resin composition easily penetrates into gaps between coil wires.

In order to achieve the above objects, a resin composition is provided as follows. A thermosetting resin and a filler dispersed in the thermosetting resin are included. Here, a particle size curve of the filler has a small-diameter peak, a large-diameter peak having a higher frequency than that of the small-diameter peak, and a valley which is positioned between the small-diameter peak and the large-diameter peak and has a lower frequency than that of the small-diameter peak.

FIG. 1 is a schematic diagram (semilogarithmic graph) showing a particle size curve for the above-mentioned filler. The filler has the distinctive particle size dispersed in the thermosetting resin as a base material. Adjustment of the filler's particle size improves the resin composition's fluidity.

In addition, to achieve the another object, an ignition coil device is provided with a primary coil, a secondary coil, and the above-mentioned resin composition. The primary coil is formed by winding a primary coil wire. The secondary coil is formed by winding a secondary coil wire. The resin composition penetrates into gaps between turns of the primary coil wire and the secondary coil wire and is cured.

This structure enables the resin composition to easily penetrate into gaps between turns of the primary coil wire and the secondary coil wire. Furthermore, it is possible to decrease the linear expansion coefficient of the resin composition by means of the filler having so small a particle diameter as not to hinder the resin composition from flowing. This results in restricting dielectric breakdown between turns of the coil wire and irregular winding of the coil wire.

This structure also enables the filler to be dispersed in the resin composition. For this reason, there is only a small difference between the linear expansion coefficient for the resin composition and the linear expansion coefficient for each member constituting the ignition coil device. Therefore, there is little possibility of causing defects such as a crack.

BRIEF DESCRIPTION OF THE DRAWINGS

The above and other objects, features, and advantages of the present invention will become more apparent from the following detailed description made with reference to the accompanying drawings. In the drawings.

DETAILED DESCRIPTION OF THE PREFERRED EMBODIMENTS

Embodiments of the ignition coil device according to the present invention will now be described. The following also describes embodiments of the resin composition according to the present invention.

[First Embodiment]

Figure 2:
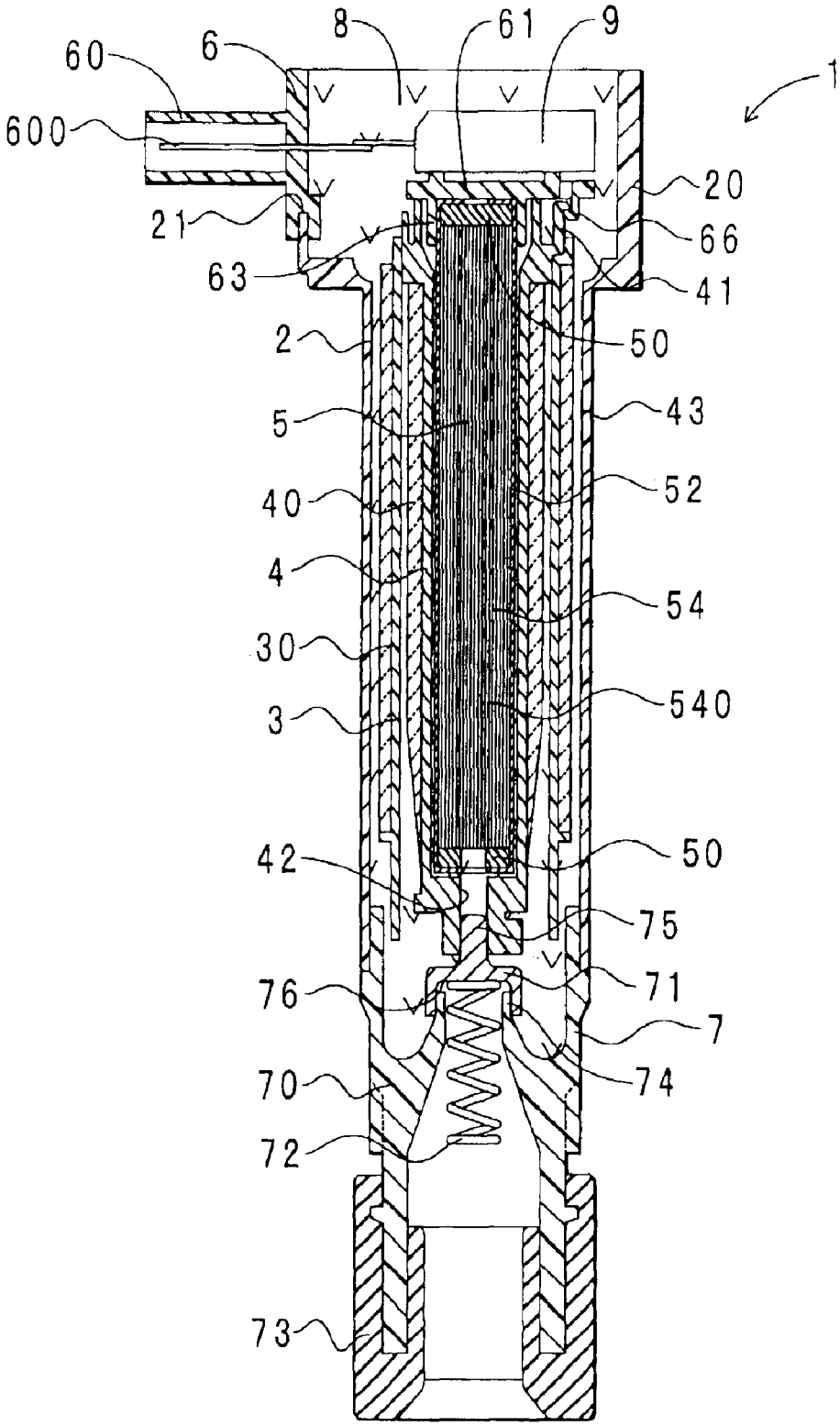
FIG. 2 is an axial sectional view of an ignition coil device according to a first embodiment of the present invention.

A configuration of the ignition coil device according to the embodiment will be described first. FIG. 2 shows an axial sectional view of the ignition coil device according to the embodiment. A so-called stick-type ignition coil device 1 is housed in a plug hole (not shown) formed in each cylinder at the top of an engine block. As will be discussed below, the ignition coil device 1 is connected to an ignition plug (not shown) at the bottom in the drawing.

The ignition coil device 1 has a housing 2. The housing 2 is made of resin and is formed like a stepped tube with widening diameters upward. The housing 2 is formed cylindrically below the step and rectangularly above the step. There is formed a wide-mouthed section 20 at the top end of the housing 2. A cutout window 21 is formed in part of a side wall of the wide-mouthed section 20.

The inside of the housing 2 includes a central core section 5, a primary spool 3, a primary coil 30, a secondary spool 4, a secondary coil 40, a pedestal 61 of a connector 6, and an ignitor 9.

The central core section 5 comprises a central core 54, an elastic member 50, and a heat-shrinkable tube 52. The central core 54 is formed by layering strip-formed silicon steel plates 540 with different widths in a diametrical direction and is formed like a stick. The elastic member 50 is made of monofoam sponge and is formed like a column. The elastic member 50 is provided at both ends of the central core 54. The heat-shrinkable tube 52 is made of resin that shrinks due to heating. The heat-shrinkable tube 52 covers the central core 54 and the elastic member 50 from the outside.

The secondary spool 4 is made of resin and is formed like a cylinder having a base. The secondary spool 4 is arranged coaxially with the central core section 5 and adjacently to an outside periphery of the central core section 5. The secondary coil 40 comprises a secondary coil wire wound around an outside periphery of the secondary spool 4. A spool oriented engaging nail 41 is vertically provided on the top surface of the secondary spool 4. There are provided three spool oriented engaging nails 41 each separated 90 or 180 degrees from each other along a circumferential direction.

The primary spool 3 is arranged coaxially with the secondary spool 4 and adjacently to an outside periphery of the secondary spool 4. The primary coil 30 comprises a primary coil wire wound around an outside periphery of the primary spool 3. An outside periphery of the primary coil 30 is provided with a cylindrical peripheral core 43 comprising a single silicon steel plate that has a slit piercing in a longer direction.

The connector 6 is made of resin and comprises a connector body 60 and the pedestal 61. The connector body 60 is formed as a square tube and is disposed so as to protrude from the cutout window 21 toward the outside of the housing 2. A plurality of connector terminals 600 is insert molded in the connector body 60. The pedestal 61 is formed like a flat plane. The pedestal 61 is disposed approximately at the center of the wide-mouthed section 20. An aligning rib 63 and an aligning member oriented engaging nail 66 are vertically provided from the bottom surface of the pedestal 61. The aligning rib 63 is formed as a ring. The aligning rib 63 is inserted between the central core section 5 and the secondary spool 4 from the top. There are provided three aligning member oriented engaging nails 66 each separated 90 or 180 degrees from each other along a circumferential direction. The aligning member oriented engaging nail 66 engages with the spool oriented engaging nail 41.

The ignitor 9 is formed from a power transistor (not shown), a hybrid integrated circuit (not shown), a heat sink (not shown), and the like that are sealed with mold resin. The ignitor 9 is electrically connected to an ECU (engine control unit, not shown) and the primary coil 30.

A resin composition 8 is filled in between the above-mentioned members disposed in the housing 2. The resin composition 8 includes an epoxy resin, a filler, and a hardener. The resin composition 8 is injected from the wide-mouthed section 20 into the vacuumed housing 2, penetrates between the above-mentioned members, and hardens. The resin composition 8 will be discussed in more detail below.

A high voltage tower 7 is disposed toward the bottom of the housing 2. The high voltage tower 7 comprises a tower housing 70, a high voltage terminal 71, a spring 72, and a plug cap 73.

The tower housing 70 is made of resin and is formed cylindrically. An upward protruding boss 74 is formed in the middle of the inside periphery of the tower housing 70. The high voltage terminal 71 is made of metal and is formed like a cup having a downward aperture 76. The boss 74 is inserted into the downward aperture 76. That is to say, the boss 74 supports the high voltage terminal 71. There is disposed an upward protuberant projection 75 from the center of the top end of the high voltage terminal 71. The projection 75 is inserted into a bottom end aperture 42 of the secondary spool 4. The projection 75 is electrically connected to the secondary coil 40.

The spring 72 is formed spirally. An aperture 76 of the high voltage terminal 71 stops the top end of the spring 72. The spring 72 connects with an ignition plug.

The plug cap 73 is made of rubber and is formed like a cylinder. The plug cap 73 is circularly attached to the bottom end of the tower housing 70. The ignition plug is pressed into and is elastically connected to the inside periphery of the plug cap 73.

The following describes operations of the ignition coil device 1 according to the embodiment when electrical power is supplied. A control signal from the ECU is transmitted to the ignitor 9 via the connector 6. When the ignitor 9 interrupts an electric current, a self-induction effect generates a specified voltage in the primary coil 30. This voltage is boosted due to a mutual induction effect between the primary coil 30 and the secondary coil 40. A high voltage generated due to the boost is transmitted to the ignition plug from the secondary coil 40 via the high voltage terminal 71 and the spring 72. The high voltage generates a spark in a gap of the ignition plug.

Figure 3:
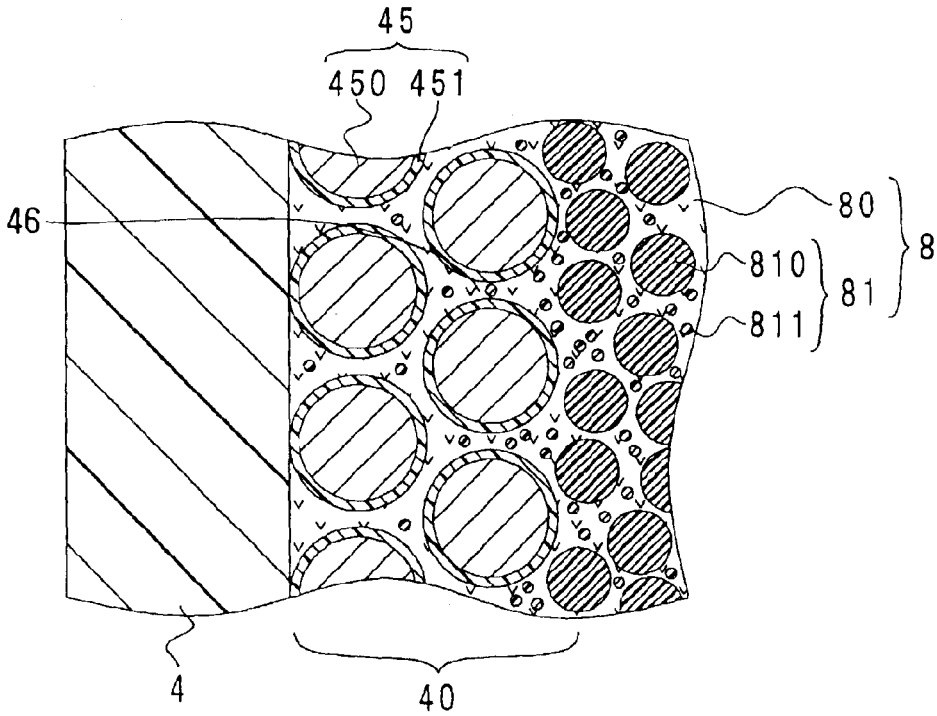
FIG. 3 is an axial sectional view near a secondary coil of the ignition coil device according to the first embodiment.

The following describes the resin composition for the ignition coil device 1 according to the embodiment. FIG. 3 shows an axial sectional view near the secondary coil of the ignition coil device 1 according to the embodiment. As shown in FIG. 3, the secondary coil wire 45 constituting the secondary coil 40 comprises a conductor 450 and a coat 451. An external diameter of the wire body including the coat ranges from 0.04 to 0.09 mm. The secondary coil wire 45 is wound around the secondary spool 5000 to 25000 times as long as 40 to 100 mm along the axis direction. A fine gap 46 is formed between turns of the secondary coil wire 45.

The resin composition 8 includes an epoxy resin 80, a filler 81, and a hardener (not shown). The epoxy resin 80 is included in a thermosetting resin according to the present invention. The filler 81 is formed of two types of orbicular silica with different diameters. That is to say, the filler comprises a large-diameter particle 810 and a small-diameter particle 811. The large-diameter particle 810 has a particle diameter of 40 $\mu$m. The small-diameter particle 811 has a particle diameter of 0.5 $\mu$m. When the entire of the resin composition 8 is assumed to be 100 mass %, the filler 81 is included 75 mass %. Of the 75 mass % filler 81, the small-diameter particle 811 occupies 15 mass % and the large-diameter particle 810 occupies 60 mass %.

Figure 1:
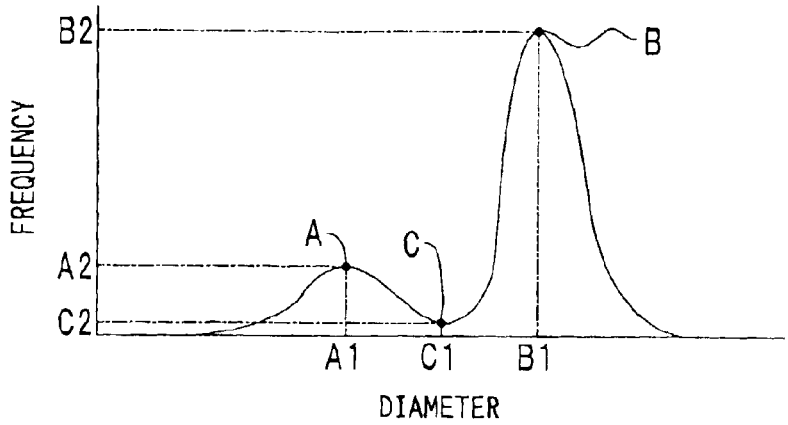
FIG. 1 is a schematic diagram showing a particle size curve for a filler.
Figure 4:
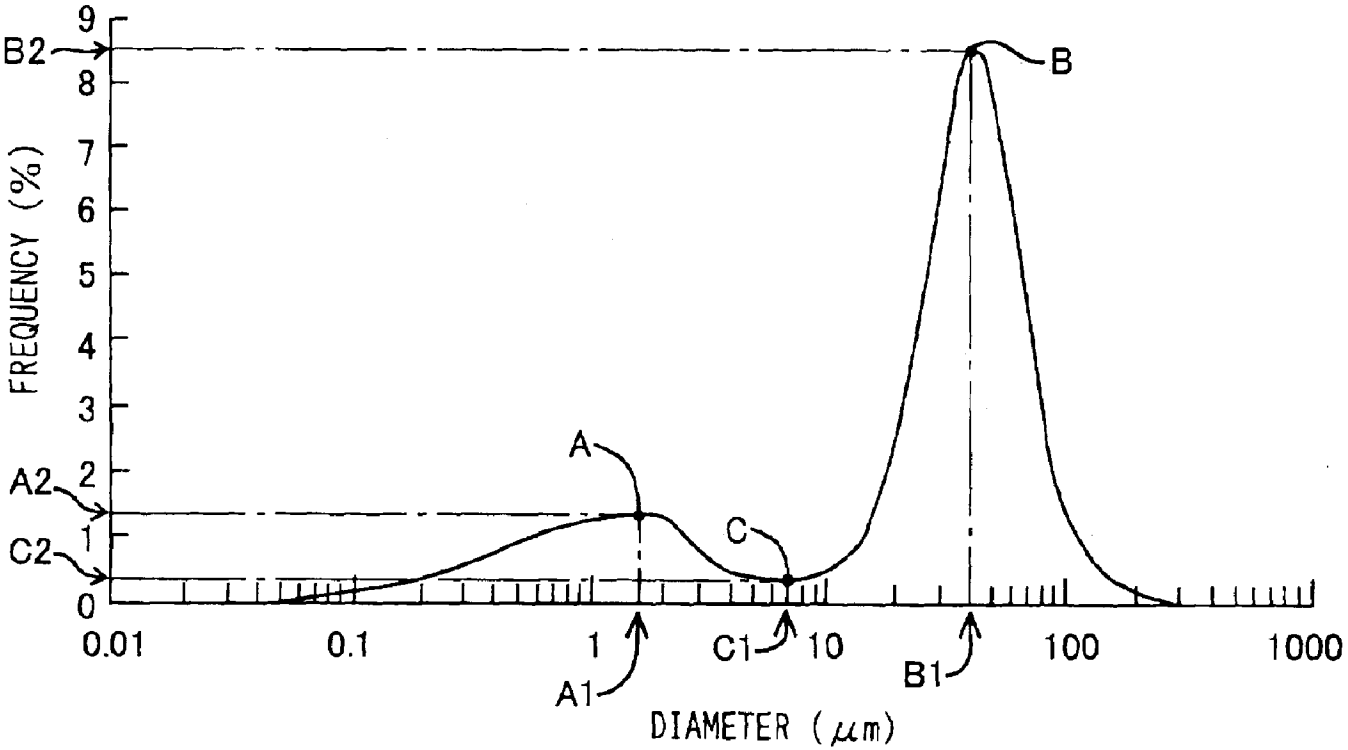
FIG. 4 is a schematic diagram showing a particle size curve for a filler in a resin composition according to the first embodiment.

FIG. 4 shows a particle size curve of the filler used for the resin composition according to the embodiment. This particle size curve is measured with a particle size distribution analyzer (manufactured by Horiba, Ltd., model LA-700). In FIG. 4, the abscissa shows a particle diameter ($\mu$m). The ordinate indicates a frequency (%). The mutually corresponding parts in FIGS. 4 and 1 are designated by the same reference symbols.

As shown in FIG. 4, a particle diameter A1 at a small-diameter peak A is 1.2 $\mu$m. A particle diameter C1 at the valley is 7 $\mu$m. A particle diameter B1 at a large-diameter peak B is 40 $\mu$m. A frequency A2 of the small-diameter peak A is 1.3%. A frequency C2 of the valley is 0.4%. A frequency B2 of the large-diameter peak B is 8.6%.

Effects of the ignition coil device 1 according to the embodiment will now be described. The ignition coil device 1 according to the embodiment adjusts the particle size of the filler 81 included in the resin composition 8 so that the particle size curve forms the small-diameter peak A, the large-diameter peak B, and the valley C. That is to say, the particle diameters are set to be A1<C1<B1. The frequencies are set to be C2<A2<B2. Further, there is a ratio of B2:C2=1:0.0465. That is to say, the frequency ratio B2:C2 is set to be 0.08 or less.

The ignition coil device 1 according to the embodiment is configured so that the small-diameter particle 811 and the large-diameter particle 810 constituting the filler 81 are nearly spherical. Accordingly, relatively many gaps are formed between particles.

The ignition coil device 1 according to the embodiment is configured so that the particle size curve for the filler 81 shows the 8.6% frequency B2 at the large-diameter peak B within the range between 8% and 9%. The frequency A2 at the small-diameter peak A is 1.3% within the range between 1% and 2%. The frequency C2 at the valley C is 0.4%, i.e., 0.5% or less.

Further, the ignition coil device 1 according to the embodiment is configured so that the particle size curve for the filler 81 exhibits particle diameter ratio B1:A1:C1=1:0.03:0.175 among the large-diameter peak B, the small-diameter peak A, and the valley C.

The ignition coil device 1 according to the embodiment is configured so that the particle size curve for the filler 81 shows the 40 $\mu$m particle diameter B1 at the large-diameter peak B within the range between 30 and 50 $\mu$m. The particle diameter A1 at the small-diameter peak A is 1.2 $\mu$m within the range between 0.7 and 3 $\mu$m. The particle diameter C1 at the valley C is 7 $\mu$m within the range between 4 and 10 $\mu$m.

Further, the ignition coil device 1 according to the embodiment is configured so that the particle size curve for the filler 81 exhibits frequency ratio B2:A2=1:0.15 between the large-diameter peak B and the small-diameter peak A.

These effects make excellent fluidity of the resin composition 8 according to the embodiment. The resin composition 8 fully penetrates between turns of the primary coil wire and the secondary coil wire 45. FIG. 3 shows that the small-diameter particle 811 in the resin composition 8 penetrates into turns of the secondary coil wire 45 together with the epoxy resin. This state decreases a possibility of dielectric breakdown between turns of the coil wire. There is little possibility of irregularly winding the coil wire.

The ignition coil device 1 according to the embodiment allows the filler 81 to be dispersed in the resin composition 8.

Furthermore, the ignition coil device 1 according to the embodiment is configured so that the small-diameter particle 811 and the large-diameter particle 810 constituting the filler 81 are nearly spherical. Accordingly, the resin composition 8 can include a larger amount of the filler 81.

These effects cause a small difference between the linear expansion coefficient for the resin composition 8 and the linear expansion coefficient for the coil wire or the peripheral core adjacent to the resin composition 8. Accordingly, there is little possibility of causing defects such as a crack.

The ignition coil device 1 according to the embodiment uses the epoxy resin 80 as a thermosetting resin. The epoxy resin 80 excels in the insulation performance and is inexpensive. For this reason, the ignition coil device 1 according to the embodiment is hardly subject to dielectric breakdown. In addition, manufacturing costs can be decreased.

The ignition coil device 1 according to the embodiment uses silica as the filler 81. The silica is especially excels in an effect of decreasing the linear expansion coefficient of the resin composition 8. With this respect, there is a small difference between the linear expansion coefficient of the resin composition 8 and the linear expansion coefficient of each member constituting the ignition coil device 1. The silica used for the filler 81 may be manufactured by melting the quartz or through the use of various synthetic methods.

FIG. 3 shows an example of the small-diameter particle 811 penetrated into the secondary coil wire. In order to hinder voids from being generated, however, it is also possible to determine the size of the small-diameter particle 811 so that only the epoxy resin can penetrate into the secondary coil wire.

The ignition coil device 1 according to the embodiment is a so-called stick-type ignition coil device. When the ignition coil device 1 according to the present invention is used as a stick-type ignition coil device like the embodiment, the resin composition 8 fully penetrates between turns of the coil wire. Consequently, it is possible to suppress dielectric breakdown.

[Second Embodiment]

The second embodiment differs from the first embodiment in that a ringlike coil wire holding rib is provided on an outside peripheral surface of the secondary spool at a specified interval along the axial direction. While the secondary coil wire according to the first embodiment is wound slantwise, the secondary coil wire according to the second embodiment is wound regularly. Accordingly, the following describes only the difference.

Figure 5:
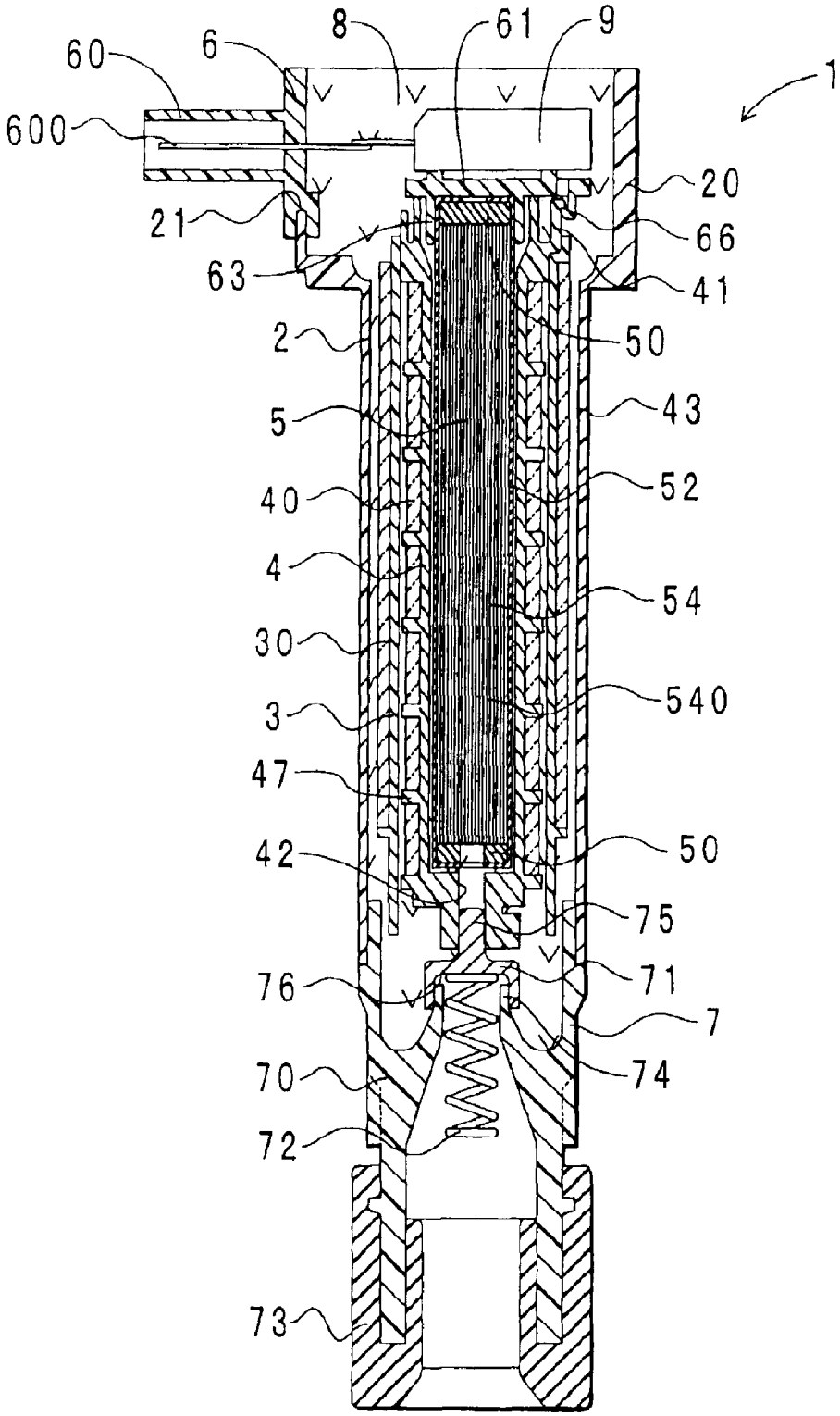
FIG. 5 is an axial sectional view of an ignition coil device according to a second embodiment of the present invention.
Figure 6:
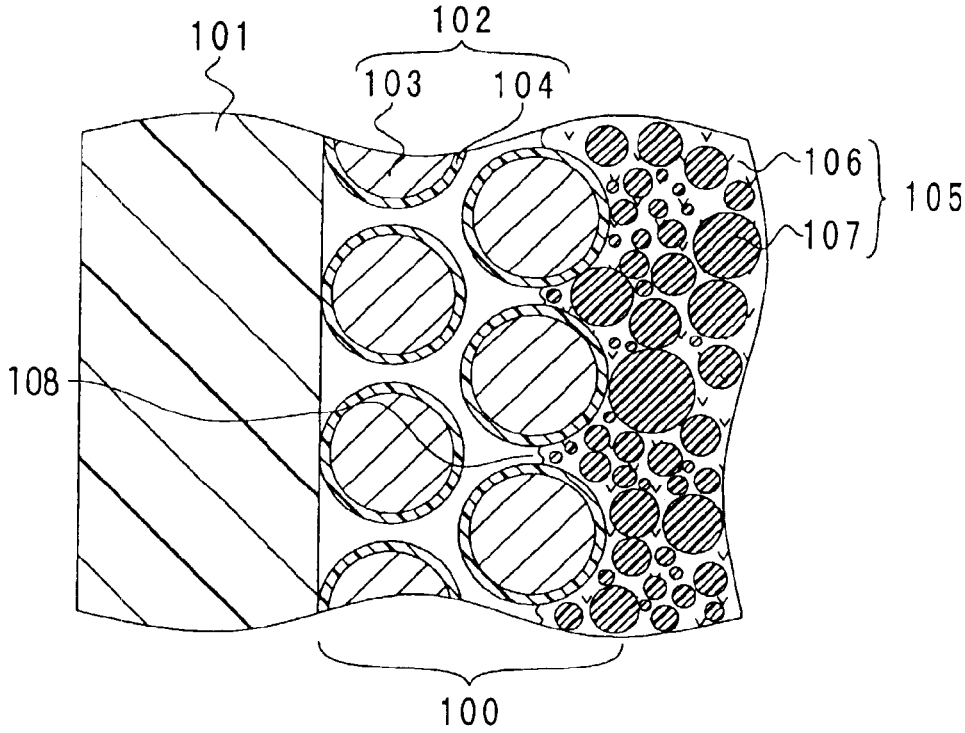
FIG. 6 RELATED ART
FIG. 6 is an axial sectional view near a secondary coil of an ignition coil device of a related art.

FIG. 5 shows an axial sectional view of the ignition coil device 1 according to the second embodiment. The mutually corresponding parts in FIGS. 5 and 1 are designated by the same reference numerals. As shown in FIG. 5, a coil wire holding rib 47 is provided on an outside peripheral surface of the secondary spool 4 integrally therewith. A total of seven coil wire holding ribs 47 are disposed at a specified interval along the axial direction of the secondary spool 4. The secondary coil wire is regularly wound between the adjacent coil wire holding ribs 47 to form the secondary coil 40.

The ignition coil device 1 according to the embodiment provides the same effects as those of the ignition coil device 1 according to the first embodiment. The ignition coil device 1 according to the embodiment allows the secondary coil wire to be wound around short sections separated by the coil wire holding ribs 47. This further decreases a possibility of irregularly winding the secondary coil wire.

EXAMPLES

The following describes a characteristics evaluation experiment conducted for the resin composition according to the present invention.

<Compositions of Examples and Comparative Examples>

(1) Example 1

A resin composition sample for example 1 comprises a resin component and a filler component. The resin component comprises an epoxy resin and a hardener. When the entire sample is assumed to be 100 mass %, the resin component occupies 25 mass %. The epoxy resin comprises a bisphenol A type epoxy resin and a bisphenol F type epoxy resin. The hardener comprises hexahydrophthalic acid anhydride. Here, the ratio of the epoxy resin and the hardener is 1:0.75–0.95.

The filler comprises a spherical silica and a spherical mullite. When the entire sample is assumed to be 100 mass %, the filler occupies 75 mass %. Of 75 mass %, the spherical silica occupies 18 mass % and the spherical mullite occupies 57 mass %. The spherical silica has a particle diameter of 0.5 μm. The spherical mullite has a particle diameter of 100 μm.

(2) Example 2

A resin composition sample for example 2 comprises a resin component and a filler component. The resin component comprises an epoxy resin and a hardener. When the entire sample is assumed to be 100 mass %, the resin component occupies 25 mass %. The epoxy resin comprises a bisphenol A type epoxy resin and a bisphenol F type epoxy resin. The hardener comprises hexahydrophthalic acid anhydride. Here, the ratio of the epoxy resin and the hardener is 1:0.75–0.95.

The filler comprises two types of spherical silicas with different particle diameters. When the entire sample is assumed to be 100 mass %, the filler occupies 75 mass %. Of 75 mass %, a spherical silica having 0.5 μm particle diameter occupies 18 mass %. Of 75 mass %, a spherical silica having 40 μm particle diameter occupies 57 mass %.

(3) Example 3

A resin composition sample for example 3 comprises a resin component and a filler component. The resin component comprises an epoxy resin and a hardener. When the entire sample is assumed to be 100 mass %, the resin component occupies 25 mass %. The epoxy resin comprises a bisphenol A type epoxy resin and a bisphenol F type epoxy resin. The hardener comprises hexahydrophthalic acid anhydride. Here, the ratio of the epoxy resin and the hardener is 1:0.75–0.95.

The filler comprises two types of spherical silicas with different particle diameters. When the entire sample is assumed to be 100 mass %, the filler occupies 75 mass %. Of 75 mass %, a spherical silica having 6 μm particle diameter occupies 48 mass % Of 75 mass %, a crushed (irregular shaped) silica having 165 μm particle diameter occupies 27 mass %.

(4) Example 4

A resin composition sample for example 4 comprises a resin component and a filler component. The resin component comprises an epoxy resin and a hardener. When the entire sample is assumed to be 100 mass %, the resin component occupies 26 mass %. The epoxy resin comprises a bisphenol A type epoxy resin and a bisphenol F type epoxy resin. The hardener comprises hexahydrophthalic acid anhydride. Here, the ratio of the epoxy resin and the hardener is 1:0.75–0.95.

The filler comprises a spherical silica and a spherical mullite. When the entire sample is assumed to be 100 mass %, the filler occupies 74 mass %. Of 74 mass %, the spherical silica occupies 5.8 mass % and the spherical mullite occupies 68.2 mass %. The spherical silica has a particle diameter of 0.5 μm. The spherical mullite has a particle diameter of 100 μm.

(5) Example 5

A resin composition sample for example 5 comprises a resin component and a filler component. The resin component comprises an epoxy resin and a hardener. When the entire sample is assumed to be 100 mass %, the resin component occupies 26.2 mass %. The epoxy resin comprises a bisphenol A type epoxy resin and a bisphenol F type epoxy resin. The hardener comprises hexahydrophthalic acid anhydride. Here, the ratio of the epoxy resin and the hardener is 1:0.75–0.95.

The filler comprises a spherical silica and a spherical mullite. When the entire sample is assumed to be 100 mass %, the filler occupies 73.8 mass %. Of 73.8 mass %, the spherical silica occupies 5 mass % and the spherical mullite occupies 68.8 mass %. The spherical silica has a particle diameter of 0.5 μm. The spherical mullite has a particle diameter of 100 μm.

(6) Example 6

A resin composition sample for example 6 comprises a resin component and a filler component. The resin component comprises an epoxy resin and a hardener. When the entire sample is assumed to be 100 mass %, the resin component occupies 26.1 mass %. The epoxy resin comprises a bisphenol A type epoxy resin and a bisphenol F type epoxy resin. The hardener comprises hexahydrophthalic acid anhydride. Here, the ratio of the epoxy resin and the hardener is 1:0.75–0.95.

The filler comprises a spherical silica and a spherical mullite. When the entire sample is assumed to be 100 mass %, the filler occupies 73.9 mass %. Of 73.9 mass %, the spherical silica occupies 11 mass % and the spherical mullite occupies 62.9 mass %. The spherical silica has a particle diameter of 0.5 μm. The spherical mullite has a particle diameter of 100 μm.

(7) Example 7

A resin composition sample for example 7 comprises a resin component and a filler component. The resin component comprises an epoxy resin and a hardener. When the entire sample is assumed to be 100 mass %, the resin component occupies 12.7 mass %. The epoxy resin comprises a bisphenol A type epoxy resin and a bisphenol F type epoxy resin. The hardener comprises hexahydrophthalic acid anhydride. Here, the ratio of the epoxy resin and the hardener is 1:0.75–0.95.

The filler comprises a spherical silica and a spherical mullite. When the entire sample is assumed to be 100 mass %, the filler occupies 87.3 mass %. Of 87.3 mass %, the spherical silica occupies 21.7 mass % and the spherical mullite occupies 65.6 mass %. The spherical silica has a particle diameter of 0.5 μm. The spherical mullite has a particle diameter of 100 μm.

(8) Example 8

A resin composition sample for example 8 comprises a resin component and a filler component. The resin component comprises an epoxy resin and a hardener. When the entire sample is assumed to be 100 mass %, the resin component occupies 19 mass %. The epoxy resin comprises a bisphenol A type epoxy resin and a bisphenol F type epoxy resin. The hardener comprises hexahydrophthalic acid anhydride. Here, the ratio of the epoxy resin and the hardener is 1:0.75–0.95.

The filler comprises two types of spherical silicas with different particle diameters. When the entire sample is assumed to be 100 mass %, the filler occupies 81 mass %. Of 81 mass %, a spherical silica having 0.5 μm particle diameter occupies 19.8 mass %. Of 81 mass %, a spherical silica having 40 μm particle diameter occupies 61.2 mass %.

(9) Example 9

A resin composition sample for example 9 comprises a resin component and a filler component. The resin component comprises an epoxy resin and a hardener. When the entire sample is assumed to be 100 mass %, the resin component occupies 25 mass %. The epoxy resin comprises a bisphenol A type epoxy resin and a bisphenol F type epoxy resin. The hardener comprises hexahydrophthalic acid anhydride. Here, the ratio of the epoxy resin and the hardener is 1:0.75–0.95.

The filler comprises two types of spherical silicas with different particle diameters. When the entire sample is assumed to be 100 mass %, the filler occupies 75 mass %. Of 75 mass %, a spherical silica having 0.5 μm particle diameter occupies 15 mass %. Of 75 mass %, a spherical silica having 40 μm particle diameter occupies 60 mass %. The ignition coil device 1 according to the above-mentioned embodiments is injected with the resin composition with the same composition as that for example 9.

(10) Example 10

A resin composition sample for example 10 comprises a resin component and a filler component. The resin component comprises an epoxy resin and a hardener. When the entire sample is assumed to be 100 mass %, the resin component occupies 23 mass %. The epoxy resin comprises a bisphenol A type epoxy resin and a bisphenol F type epoxy resin. The hardener comprises hexahydrophthalic acid anhydride. Here, the ratio of the epoxy resin and the hardener is 1:0.75–0.95.

The filler comprises two types of spherical silicas with different particle diameters. When the entire sample is assumed to be 100 mass %, the filler occupies 77 mass %. Of 77 mass %, a spherical silica having 0.5 μm particle diameter occupies 15.4 mass %. Of 77 mass %, a spherical silica having 40 μm particle diameter occupies 61.6 mass %.

(11) Comparative Example 1

A resin composition sample for comparative example 1 comprises a resin component and a filler component. The resin component comprises an epoxy resin and a hardener. When the entire sample is assumed to be 100 mass %, the resin component occupies 25 mass %. The epoxy resin comprises a bisphenol A type epoxy resin and a bisphenol F type epoxy resin. The hardener comprises hexahydrophthalic acid anhydride. Here, the ratio of the epoxy resin and the hardener is 1:0.75–0.95.

The filler comprises three types of spherical silicas with different particle diameters. When the entire sample is assumed to be 100 mass %, the filler occupies 75 mass %. Of 75 mass %, a spherical silica having 0.5 μm particle diameter occupies 18 mass %. Of 75 mass %, a spherical silica having 6 μm particle diameter occupies 19 mass %. Of 75 mass %, a spherical silica having 40 μm particle diameter occupies 38 mass %.

(12) Comparative Example 2

A resin composition sample for comparative example 2 comprises a resin component and a filler component. The resin component comprises an epoxy resin and a hardener. When the entire sample is assumed to be 100 mass %, the resin component occupies 26 mass %. The epoxy resin comprises a bisphenol A type epoxy resin and a bisphenol F type epoxy resin. The hardener comprises hexahydrophthalic acid anhydride. Here, the ratio of the epoxy resin and the hardener is 1:0.75–0.95.

The filler comprises one type of spherical mullite. The spherical mullite has a particle diameter of 100 μm. When the entire sample is assumed to be 100 mass %, the filler occupies 74 mass %. The spherical mullite has a particle diameter of 100 μm.

<Characteristics Evaluation Methods>

(1) Mesh Transmissivity

We measured mesh transmissivities in order to evaluate fluidities of the samples used for the above-mentioned examples and comparative examples. A better fluidity results from the sample that indicates a higher mesh transmissivity. We conducted the measurement by weighing 5 g of each of the samples used for the above-mentioned examples and comparative examples and allowing them to pass through an SUS mesh. The mesh width is 5 mm. The transmissivity (%) is calculated according to the equation: mesh transmission amount (g)/5 (g)×100.

(2) Coil Wire Impregnating Ability

We measured the coil wire impregnating ability in order to evaluate impregnating abilities of the samples used for the above-mentioned examples and comparative examples between turns of the coil wire in the ignition coil device 1. The sample with a higher coil wire impregnating ability can be more easily impregnated into gaps between turns of the coil wire. To conduct the measurement, we injected the samples used for the above-mentioned examples and comparative examples into the ignition coil device 1, cured the samples, and then cut the ignition coil device 1 along the axial direction to observe the section by a microscope.

(3) Filler Precipitability

We measured the filler precipitability in order to evaluate dispersibilities of the fillers in the samples used for the above-mentioned examples and comparative examples. The sample with a lower filler precipitability can allow the filler to more evenly disperse in the sample. For the measurement, we poured the samples used for the above-mentioned examples and comparative examples into beakers, left the beakers as they were at a constant temperature of 40° C. for ten days, and visually checked the beaker bottoms.

<Characteristics Evaluation Results>

Table 1 lists characteristics evaluation results together with the compositions of the samples used for the above-mentioned examples and comparative examples.

TABLE 1

| | EXA. | | | | | | | | | | COM. | |
|---|---|---|---|---|---|---|---|---|---|---|---|---|
| SAMPLE | 1 | 2 | 3 | 4 | 5 | 6 | 7 | 8 | 9 | 10 | 1 | 2 |
| SPHERE SILICA (0.5 μm) (mass %) | 18 | 18 | 0 | 5.8 | 5 | 11 | 21.7 | 19.8 | 15 | 15.4 | 18 | 0 |
| SPHERE SILICA (6 μm) (mass %) | 0 | 0 | 48 | 0 | 0 | 0 | 0 | 0 | 0 | 0 | 19 | 0 |
| SPHERE SILICA (40 μm) (mass %) | 0 | 57 | 0 | 0 | 0 | 0 | 0 | 61.2 | 60 | 61.6 | 38 | 0 |
| CRUSHED SILICA (165 μm) (mass %) | 0 | 0 | 27 | 0 | 0 | 0 | 0 | 0 | 0 | 0 | 0 | 0 |
| SPHERE MULLITE (100 μm) (mass %) | 57 | 0 | 0 | 68.2 | 68.8 | 62.9 | 65.6 | 0 | 0 | 0 | 0 | 74 |
| FILLER (mass %) | 75 | 75 | 75 | 74 | 73.8 | 73.9 | 87.3 | 81 | 75 | 77 | 75 | 74 |
| MESH TRANSMISSIVITY (%) | 3.5 | 0.72 | 0.95 | 2.28 | 8.59 | 6.09 | 0.52 | 0.72 | 2.1 | 2.4 | 0.01 | 3.91 |
| COIL WIRE IMPREGNATING ABILITY | H | I | H | H | H | H | I | I | H | H | L | H |
| FILLER PRECIPITABILITY | Y | N | Y | Y | Y | Y | Y | N | N | N | N | Y |

(1) Mesh Transmissivity

We found that comparative example 1 shows a remarkably low mesh transmissivity. Further, we found that examples 1, 4, 5, 6, 9, and 10, and comparative example 2 show high mesh transmissivities. Examples 5 and 6 show especially high mesh transmissivities.

(2) Coil Wire Impregnating Ability

We found that comparative example 1 shows a remarkably low (L) coil wire impregnating ability. Further, we found that examples 2, 7, and 8 show intermediate (I) coil wire impregnating abilities. Moreover, we found that examples 1, 3, 4, 5, 6, 9, and 10, and comparative example 2 show high (H) coil wire impregnating abilities.

(3) Filler Precipitability

With respect to the precipitability, examples 1, 3, 4, 5, 6, and 7, and comparative example 2 showed precipitation (Y) of the fillers. On the other hand, examples 2, 8, 9, and 10, and comparative example 1 showed no precipitation (N) of the fillers. Consequently, we found that examples 2, 8, 9, and 10, and comparative example 1 are characterized by low filler precipitabilities.

<Conclusion>

According to the characteristics evaluation results, we found that several embodiments reach practical levels of the mesh transmissivity and the coil wire impregnating ability. In consideration for the filler precipitability as well, we found that examples 9 and 10 especially excel in the characteristic balance.

[Additional Explanation]

(1) The resin composition according to the present invention includes the filler having the distinctive particle size dispersed in the thermosetting resin as a base material. The inventors of the present invention gave attention to the particle size of the filler. We found that the resin composition's fluidity improves by adjusting the filler's particle size so that the particle size curve forms two peaks and a valley with a specified depth.

FIG. 1 is a schematic diagram (semilogarithmic graph) showing a particle size curve for the filler. In FIG. 1, the abscissa indicates a particle diameter and the ordinate indicates a frequency. The particle diameter is calculated with reference to the cubic volume. As shown in FIG. 1, a particle diameter A1 at a small-diameter peak A is smaller than a particle diameter B1 at a large-diameter peak B. A particle diameter C1 at a valley C is larger than the particle diameter A1 and is smaller than the particle diameter B1. That is to say, the particle diameters are set to be A1<C1<B1.

A frequency B2 at the large-diameter peak B is set to be higher than a frequency A2 at the small-diameter peak A. A frequency C2 at the valley C is set to be lower than the frequency A2. That is to say, the frequencies are set to be C2<A2<B2. The purpose of C2<A2<B2 is to make clearer two peaks, i.e., the small-diameter peak A and the large-diameter peak B. The relationship A2<B2 is settled because the particle diameter A1 at the small-diameter peak A and the particle diameter B1 at the large-diameter peak B maintain the relationship A1<B1 as mentioned above. This is because filler particles with a large particle diameter form a larger gap than a gap formed by filler particles with a small particle diameter. The thermosetting resin and filler particles can well flow through this large gap.

In this manner, the resin composition according to the present invention includes the filler having the distinctive particle size. Accordingly, the resin composition according to the present invention is excellent in the fluidity. The thermosetting resin's fluidity is especially excellent.

(2) It is preferable that particles of the filler are nearly spherical. According to this aspect, the resin composition can include more filler than irregularly shaped filler particles. This makes it easy to adjust the linear expansion coefficient of the resin composition. Spherical filler particles easily form gaps therebetween. This improves the thermosetting resin fluidity. The filler particles themselves are hardly interfered by the other filler particles. This also improves the filler particle fluidity.

(3) It is preferable that the thermosetting resin is an epoxy resin. The epoxy resin excels in heat resistance and insulation performance and is inexpensive. The use of the epoxy resin for the thermosetting resin improves the insulation reliability of the resin composition and decreases manufacturing costs of the resin composition.

(4) It is preferable that a frequency ratio of the large-diameter peak and the small-diameter peak is 1:0.1–0.2. This aspect specifies B2:A2=1:0.1–0.2 in FIG. 1 mentioned above. Here, the frequency A2 is set to 0.1 or more because the frequency A2, if set to less than 0.1, decreases the critical content of the filler in the resin composition.

Compared to filler particles with a large particle diameter, filler particles with a small particle diameter can be more densely and easily mixed into a resin insulation composition. For this reason, the frequency A2, if set to less than 0.1, causes a low frequency for filler particles with a small particle diameter. This decreases the critical content of the filler in the resin composition. As a result, it becomes difficult to adjust the linear expansion coefficient of the resin composition.

The frequency A2 is set to 0.2 or less because the frequency A2, if set to higher than 0.2, degrades fluidity of the thermosetting resin and the filler. That is to say, filler particles having the particle diameter A1 penetrate into gaps between filler particles having the particle diameter B1. If the frequency A2 exceeds 0.2, the frequency of filler particles having the particle diameter A1 increases, degrading fluidity of the thermosetting resin and the filler.

(5) It is preferable that a frequency of the large-diameter peak is 8% to 9%, a frequency of the small-diameter peak is 1% to 2%, and a frequency of the valley 0.5% or less. This aspect sets B2 to a range from 8% to 9%, the frequency A2 to a range from 1% to 2%, and the frequency C2 to 0.5% or less in FIG. 1. As it is apparent from the above-mentioned examples, the resin composition including the filler having the particle size according to this aspect especially excels in a balance among the fluidity, the coil wire impregnating ability, and the filler precipitability.

(6) It is preferable that the large-diameter peak, the small-diameter peak, and the valley show a particle diameter ratio of 1:0.01–0.07:0.09–0.25. This aspect specifies B1:A1:C1=1:0.01–0.07:0.09–0.25 in FIG. 1. Here, the particle diameter A1 is set to 0.01 or larger for the following reason. If the particle diameter A1 is set to smaller than 0.01, the small-diameter peak A becomes too distant from the large-diameter peak B, degrading the resin composition fluidity. The particle diameter A1 is set to 0.07 or less for the following reason. If the particle diameter A1 exceeds 0.07, the small-diameter peak A approaches the large-diameter peak B excessively, also degrading the resin composition fluidity.

The particle diameter C1 is set to 0.09 or more for the following reason. If the particle diameter C1 is set to smaller than 0.09, the valley C approaches the small-diameter peak A excessively, degrading the resin composition fluidity. The particle diameter C1 is set to 0.25 or less for the following reason. If the particle diameter C1 exceeds 0.25, the valley C approaches the large-diameter peak B excessively, also degrading the resin composition fluidity.

(7) It is preferable that the large-diameter peak has a particle diameter of 30 to 50 μm, the small-diameter peak has a particle diameter of 0.7 to 3 μm, and the valley has a particle diameter of 4 to 10 μm. This aspect sets the particle diameter B1 to a range from 30 to 50 μm, the particle diameter A1 to a range from 0.7 to 3 μm, and the particle diameter C1 to a range from 4 to 10 μm. As it is apparent from the above-mentioned examples, the resin composition including the filler having the particle size according to this aspect especially excels in a balance among the fluidity, the coil wire impregnating ability, and the filler precipitability.

(8) It is preferable that a frequency ratio of the valley to the large-diameter peak is 0.08 or less. This aspect sets the frequency B2 at the large-diameter peak B and the frequency C2 at the valley C to B2:C2=1:0.08 or less in FIG. 1. The frequencies are set to B2:C2=1:0.08 or less for the following reason. If the frequency C2 exceeds 0.08, the frequency increases for filler particles having the particle diameter C1 at the valley C, smoothing a curve between the small-diameter peak A and the large-diameter peak B. That is to say, this widens the particle size of the entire filler particles. If the particle size widens, filler particles having various particle diameters smaller than the particle diameter B1 are relatively densely filled into gaps between filler particles having the particle diameter B1. This degrades fluidity of the thermosetting resin and the filler particles in gaps. For this reason, the aspect specifies B2:C2=1:0.08 or less.

(9) The ignition coil device according to the present invention comprises the primary coil, the secondary coil, and the resin composition. The primary coil is formed by winding the primary coil wire. The secondary coil is formed by winding the secondary coil wire. The resin composition penetrates into gaps between turns of the primary coil wire and the secondary coil wire and is cured.

The resin composition used for the ignition coil device according to the present invention includes the filler having the distinctive particle size, as described in aspect (1) above. In more detail, the resin composition can smoothly flow because of the low frequency of so large a filler as to clog gaps between large-diameter fillers or between the large-diameter filler and the coil wire. Accordingly, the resin composition excels in the fluidity from the outside periphery of the coil wire to the inside of turns of the coil wire. The resin composition can easily penetrate into gaps between turns of the primary coil wire and the secondary coil wire. Furthermore, it is possible to decrease the linear expansion coefficient of the resin composition by means of the filler having so small a particle diameter as not to hinder the resin composition from flowing.

The ignition coil device according to the present invention allows the resin composition to fully penetrate into as far as gaps between turns of the coil wire. Accordingly, there is little possibility of dielectric breakdown between turns of the coil wire. There is also little possibility of irregularly winding the coil wire.

The ignition coil device according to the present invention allows the filler to be dispersed in the resin composition. For this reason, there is only a small difference between the linear expansion coefficient for the resin composition and the linear expansion coefficient for each member constituting the ignition coil device. Therefore, there is little possibility of causing defects such as a crack.

(10) It is preferable that the ignition coil device is directly mounted in an engine's plug hole in the above-mentioned aspect (9). This aspect allows the ignition coil device according to the present invention to be used as a so-called stick-type ignition coil device that is inserted into a plug hole for mounting.

An inside diameter of the plug hole restricts an outside diameter of the stick-type ignition coil device. For this reason, the stick-type ignition coil device has a relatively small outside diameter. Since members with different linear expansion coefficients are assembled in a small diameter, a thermal stress occurs due to linear expansion coefficient differences. The linear expansion coefficients need to be adjusted in order to decrease the thermal stress. When the resin composition is injected, however, it cannot be fully penetrated into details. Further, the injected resin composition is thin, easily causing a dielectric breakdown. When the ignition coil device according to the present invention is used as the stick-type ignition coil device, by contrast, the resin composition fully penetrates into as far as gaps between turns of the coil wire. Accordingly, the dielectric breakdown can be suppressed.

(11) It is preferable that there is a distance ranging from 5 to 700 μm between adjacent turns of the secondary coil wire in the above-mentioned aspect (9). Here, a distance between turns is set to 700 μm or less for the following reason. There are broadly two methods of winding the coil wire, i.e., regular and slantwise. According to the regular winding method, the coil wire is wound around a spool's peripheral surface almost perpendicularly to the spool axis. According to the slantwise winding method, on the other hand, the coil wire is slantwise wound around a spool's peripheral surface by keeping a specified angle against the spool axis. Generally, the slantwise winding causes a longer distance between turns than that for the regular winding. As described in JP-A-H9-69455, the slantwise winding provides the distance between turns twice to ten times larger than the wire diameter. On the other hand, the secondary coil wire generally has a diameter of 40 to 70 μm. For these reasons, we determined a maximum value of 700 μm (=70 μm×10) for the distance between adjacent turns of the secondary coil wire. The distance between turns is set to 5 μm or more because the regular winding requires a minimum value of 5 μm for the distance between turns. The resin composition used for the ignition coil device according to the present invention excels in fluidity and easily penetrates into gaps between turns of the coil wire. Accordingly, the resin composition easily and fully penetrates into gaps between turns of the secondary coil wire having any distance between turns independently of whether the secondary coil wire is wound regularly or slantwise.

[Modification]

There have been described the embodiments of the ignition coil device 1 according to the present invention. However, the present invention is not limited to the above-mentioned embodiments.

Types of the epoxy resin are not specified especially. For example, it is possible to use bisphenol A type epoxy resin, bisphenol F type epoxy resin, hydrogenated bisphenol A type epoxy resin, hydrogenated bisphenol F type epoxy resin, cycloaliphatic epoxy resin, novolac type epoxy resin, dicyclopentadiene skeletal epoxy resin, biphenyl skeletal epoxy resin, naphthalene skeletal epoxy resin, and the like. These epoxy resins may be used independently or by mixture of two or more types. It may be preferable to use thermosetting resins other than the epoxy resins.

Types of the hardener are not specified especially. For example, it is possible to use phthalic anhydride, hexahydrophthalic acid anhydride, methylhexahydrophthalic acid anhydride, methyl nadic anhydride, aliphatic polyamine and its denatured material, aromatic polyamine and its denatured material, tetrahydrophthalic acid anhydride, methyltetrahydrophthalic acid anhydride, and the like.

Types of the filler are not specified especially. For example, it is possible to use silica, mullite, glass, calcium carbonate, magnesia, clay, talc, titanium oxide, antimony oxide, alumina, silicon nitride, silicon carbide, aluminum nitride, and the like. These fillers may be used independently or by mixture of two or more types. Shapes of the filler are not specified especially. For example, the filler may be formed like spheres, sticks, plates, flakes. When the filler is not orbicular, the particle diameter means an equivalent for the spherical diameter.

The resin composition may include additives such as an accelerator in addition to the epoxy resin, the filler, and the hardener. As accelerators, for example, it is possible to use 2-methlimidazole 2-ethyl-4-methylimidazole, 1-cyanoethyl-2-methylimidazole, 1-(2-cyanoethyl)-2-ethyl-4-methylimidazole, benzyldimethylamine, N-benzyldimethylamine, triphenylphosphine, and the like.

It will be obvious to those skilled in the art that various changes may be made in the above-described embodiments of the present invention. However, the scope of the present invention should be determined by the following claims.

What is claimed is:

1. A resin composition comprising:

a thermosetting resin; and a filler dispersed in the thermosetting resin, wherein a particle size curve of the filler has a small-diameter peak, a large-diameter peak having a higher frequency than that of the small-diameter peak, and a valley which is positioned between the small-diameter peak and the large-diameter peak and has a lower frequency than that of the small-diameter peak, and wherein a frequency ratio of the valley to the large-diameter peak is 0.08 or less.

2. The resin composition according to claim 1, wherein particles of the filler are nearly spherical.

3. The resin composition according to claim 1, wherein the thermosetting resin is an epoxy resin.

4. The resin composition according to claim 1, wherein a frequency ratio of the large-diameter peak and the small-diameter peak is between 1:0.1 and 1:0.2.

5. A resin composition comprising:

a thermosetting resin; and a filler dispersed in the thermosetting resin, wherein a particle size curve of the filler has a small-diameter peak, a large-diameter peak having a higher frequency than that of the small-diameter peak, and a valley which is positioned between the small-diameter peak and the large-diameter peak and has a lower frequency than that of the small-diameter peak, wherein a frequency of the large-diameter peak is 8% to 9%, a frequency of the small-diameter peak is 1% to 2%, and a frequency of the valley is 0.5% or less.

6. The resin composition according to claim 5, wherein particles of the filler are nearly spherical.

7. The resin composition according to claim 5, wherein the thermosetting resin is an epoxy resin.

8. A resin composition comprising:

a thermosetting resin; and a filler dispersed in the thermosetting resin, wherein a particle size curve of the filler has a small-diameter peak, a large-diameter peak having a higher frequency than that of the small-diameter peak, and a valley which is positioned between the small-diameter peak and the large-diameter peak and has a lower frequency than that of the small-diameter peak, wherein the large-diameter peak, the small-diameter peak, and the valley show a particle diameter ratio of 1:Y:Z, wherein Y is between 0.01 and 0.07 and Z is between 0.09 and 0.25.

9. The resin composition according to claim 8, wherein particles of the filler are nearly spherical.

10. The resin composition according to claim 8, wherein the thermosetting resin is an epoxy resin.

11. A resin composition comprising:

a thermosetting resin; and a filler dispersed in the thermosetting resin, wherein a particle size curve of the filler has a small-diameter peak, a large-diameter peak having a higher frequency than that of the small-diameter peak, and a valley which is positioned between the small-diameter peak and the large-diameter peak and has a lower frequency than that of the small-diameter peak, wherein the large-diameter peak, has a particle diameter of 30 to 50 $\mu$m, the small-diameter peak has a particle diameter of 0.7 to 3 $\mu$m, and the valley has a particle diameter of 4 to 10 $\mu$m.

12. The resin composition according to claim 11, wherein particles of the filler are nearly spherical.

13. The resin composition according to claim 11, wherein the thermosetting resin is an epoxy resin.

14. An ignition coil device comprising:

a primary spool which a primary coil wire is wound around and generates a voltage;

a secondary spool which a secondary coil wire is wound around, boosts the voltage generated from the primary coil, and applies the voltage to an ignition plug; and a resin composition which penetrates into gaps of the primary coil wire and of the secondary coil wire and is cured to ensure insulation, wherein the resin composition includes a thermosetting resin and a filler dispersed in the thermosetting resin, and wherein a particle size curve of the filler has a small-diameter peak, a large-diameter peak having a higher frequency than that of the small-diameter peak, and a valley which is positioned between the small-diameter peak and the large-diameter peak and has a lower frequency than that of the small-diameter peak, wherein a frequency ratio of the valley to the large-diameter peak is 0.08 or less.

15. The ignition coil device according to claim 14, wherein particles of the filler are nearly spherical.

16. The ignition coil device according to claim 14, wherein the thermosetting resin is an epoxy resin.

17. The ignition coil device to claim 14, wherein a frequency ratio of the large-diameter peak and the small-diameter peak is between 1:0.1 and 1:0.2.

18. The ignition coil device according to claim 14, wherein the ignition coil device is directly mounted in an engine's plug hole.

19. The ignition coil device according to claim 14, wherein there is a distance ranging from 5 to 700 $\mu$m between adjacent turns of the secondary coil wire.

20. The ignition coil device according to claim 14, wherein the secondary coil wire has an external diameter ranging from 0.04 $\mu$mm to 0.09 mm.

21. The ignition coil device according to claim 14, wherein the gaps of the secondary coil wire are filled with the resin composition that is cured to ensure insulation.

22. An ignition coil device comprising:

a primary spool which a primary coil wire is wound around and generates a voltage;

a secondary spool which a secondary coil wire is wound around, boosts the voltage generated from the primary coil, and applies the voltage to an ignition plug; and a resin composition which penetrates into gaps of the primary coil wire and of the secondary coil wire and is cured to ensure insulation, wherein the resin composition includes a thermosetting resin and a filler dispersed in the thermosetting resin, and wherein a particle size curve of the filler has a small-diameter peak, a large-diameter peak having a higher frequency than that of the small-diameter peak, and a valley which is positioned between the small-diameter peak and the large-diameter peak and has a lower frequency than that of the small-diameter peak, wherein a frequency of the large-diameter peak is 8% to 9%, a frequency of the small-diameter peak is 1% to 2%, and a frequency of the valley is 0.5% or less.

23. The ignition coil device according to claim 22, wherein particles of the filler are nearly spherical.

24. The ignition coil device according to claim 22, wherein the thermosetting resin is an epoxy resin.

25. The ignition coil device according to claim 22, wherein the ignition coil device is directly mounted in an engine's plug hole.

26. The ignition coil device according to claim 22, wherein there is a distance ranging from 5 to 700 $\mu$m between adjacent turns of the secondary coil wire.

27. The ignition coil device according to claim 22, wherein the secondary coil wire has an external diameter ranging from 0.04 mm to 0.09 mm.

28. The ignition coil device according to claim 22, wherein the gaps of the secondary coil wire are filled with the resin composition that is cured to ensure insulation.

29. An ignition coil device comprising:

a primary spool which a primary coil wire is wound around and generates a voltage;

a secondary spool which a secondary coil wire is wound around, boosts the voltage generated from the primary coil, and applies the voltage to an ignition plug; and a resin composition which penetrates into gaps of the primary coil wire and of the secondary coil wire and is cured to ensure insulation, wherein the resin composition includes a thermosetting resin and a filler dispersed in the thermosetting resin, and wherein a particle size curve of the filler has a small-diameter peak, a large-diameter peak having a higher frequency than that of the small-diameter peak, and a valley which is positioned between the small-diameter peak and the large-diameter peak and has a lower frequency than that of the small-diameter peak, wherein the large-diameter peak, the small-diameter peak, and the valley show a particle diameter ratio of 1:Y:Z, wherein Y is between 0.01 and 0.07 and Z is between 0.09 and 0.25.

30. The ignition coil device according to claim 29, wherein particles of the filler are nearly spherical.

31. The ignition coil device according to claim 29, wherein the thermosetting resin is an epoxy resin.

32. The ignition coil device according to claim 29, wherein the ignition coil device is directly mounted in an engine's plug hole.

33. The ignition coil device according to claim 29, wherein there is a distance ranging from 5 to 700 $\mu$m between adjacent turns of the secondary coil wire.

34. The ignition coil device according to claim 29, wherein the secondary coil wire has an external diameter ranging from 0.04 mm to 0.09 mm.

35. The ignition coil device according to claim 29, wherein the gaps of the secondary coil wire are filled with the resin composition that is cured to ensure insulation.

36. An ignition coil device comprising:

a primary spool which a primary coil wire is wound around and generates a voltage;

a secondary spool which a secondary coil wire is wound around, boosts the voltage generated from the primary coil, and applies the voltage to an ignition plug; and a resin composition which penetrates into gaps of the primary coil wire and of the secondary coil wire and is cured to ensure insulation, wherein the resin composition includes a thermosetting resin and a filler dispersed in the thermosetting resin, and wherein a particle size curve of the filler has a small-diameter peak, a large-diameter peak having a higher frequency than that of the small-diameter peak, and a valley which is positioned between the small-diameter peak and the large-diameter peak and has a lower frequency than that of the small-diameter peak, wherein the large-diameter peak has a particle diameter of 30 to 50 $\mu$m, the small-diameter peak has a particle diameter of 0.7 to 3 $\mu$m, and the valley has a particle diameter of 4 to 10 $\mu$m.

37. The ignition coil device according to claim 36, wherein particles of the filler are nearly spherical.

38. The ignition coil device according to claim 36, wherein the thermosetting resin is an epoxy resin.

39. The ignition coil device according to claim 36, wherein the ignition coil device is directly mounted in an engine's plug hole.

40. The ignition coil device according to claim 36, wherein there is a distance ranging from 5 to 700 $\mu$m between adjacent turns of the secondary coil wire.

41. The ignition coil device according to claim 36, wherein the secondary coil wire has an external diameter ranging from 0.04 mm to 0.09 mm.

42. The ignition coil device according to claim 36, wherein the gaps of the secondary coil wire are filled with the resin composition that is cured to ensure insulation.

* * * * *